United States Patent [19]

Cohen

[11] Patent Number: 5,031,766

[45] Date of Patent: Jul. 16, 1991

[54] CARRY-ALONG GARMENT BAG

[75] Inventor: David A. Cohen, New York, N.Y.

[73] Assignee: Carry-Along Corporation, New York, N.Y.

[21] Appl. No.: 561,710

[22] Filed: Aug. 2, 1990

[51] Int. Cl.[5] ..... A45C 13/22; A45C 13/30

[52] U.S. Cl. ..... 206/289; 206/287.1; 190/108; 190/102

[58] Field of Search ..... 190/102, 108; 206/286, 206/287, 287.1, 289

[56] References Cited

U.S. PATENT DOCUMENTS

| | | | |
|---|---|---|---|
| 2,154,630 | 4/1939 | Marbury et al. | 206/287.1 X |
| 2,707,035 | 4/1955 | Lashley | 190/108 X |
| 3,139,165 | 6/1964 | Taussig | 206/287.1 X |
| 3,744,600 | 7/1973 | Belland et al. | 206/287 |
| 4,170,282 | 10/1979 | Schwartzstein | 206/287.1 |
| 4,189,036 | 2/1980 | Pelavin | 206/287 X |
| 4,206,835 | 6/1980 | Shapiro | 206/287 X |
| 4,420,068 | 12/1983 | Gerch | 190/108 X |
| 4,598,803 | 7/1986 | Ghiassi | 206/287.1 X |
| 4,854,431 | 8/1989 | Pulichino, Jr. et al. | 206/287.1 X |
| 4,919,262 | 4/1990 | Kuroishi | 206/287.1 |

*Primary Examiner*—Sue A. Weaver

*Attorney, Agent, or Firm*—Carry-Along Corporation

[57] ABSTRACT

A garment bag that can be carried alone or attached to a carrying case having two sides for housing a garment piece therebetween, a zipper opening through which said garment piece can be inserted. Male and female snap pairs are located along the two sides of the garment bag for maintaining said garment bag in a two folded state such that said garment piece will remain unwrinkled therein. Two carrying case hook-ups having two elongated straps, one ending in a female clip and the other ending in a male clip are stitched in between the two sides of the garment bag for fastening the hook-ups around the handle of the carrying case. A hanger is secured inside the garment bag by a stabilizing punch screw. The hanger has a elongated nose through which the stabilizing punch screw is secured in order to provide space between the garment piece and the stabilizing punch screw when the garment piece is contained in the garment bag.

15 Claims, 1 Drawing Sheet

CARRY-ALONG GARMENT BAG

FIELD OF THE INVENTION

The invention relates generally to luggage, and more particularly to a garment bag attachable to carrying cases.

BACKGROUND OF THE INVENTION

Garment bags that are attachable to luggage are known in the prior art. In particular, there exist garment bags that combine with carrying cases to form single units for airplane travel. These devices have been developed to remedy the problem where a business person carrying documents and/or office equipment must carry a separate attache case in addition to a carrying case (made to fit underneath or above an airplane seat) and a garment bag which may be hung in a closet compartment in an airplane. By way of example, U.S. Pat. Nos. 4,420,068 and 4,206,835 illustrate various devices adapted to combine a garment bag to a carrying case for train or airplane travel.

Specifically, the device described in U.S. Pat. No. 4,206,835 employs a carrying case having a length substantially equal to the width of a garment bag. The garment bag is long enough to cover the bottom and side walls of the carrying case. The carrying case has rings on its top panel for connection to four terminating hooks attached to each end of the garment bag. The device described in U.S. Pat. No. 4,420,068 employs a garment bag having a harness opening at one end and two terminating clips at the other for insertion through the harness opening so that the garment bag attaches to a specially configured handle of a carrying case in a single folded state.

While the above described devices perform their intended purpose, they lack capacity to perform on a daily basis for work.

In hot weather, a business person usually removes his/her suit coat and holds it on his/her arm, throws it over his/her shoulder or places it down on a nearby seat. This causes inconvenience to the business person and causes the coat to wrinkle or soil. If the business person chooses to use one of the devices of the prior art, he/she is restricted to using the particular type of carrying case adapted for that particular type of garment bag, and cannot use his/her own normal attache case. Furthermore, when the carrying case of the prior art is placed on the ground, the garment bag attached thereto drags on the floor, causing the suit coat in it to wrinkle. In addition, the weight of the garment bag when attached to the carrying case will tend to cause the case to topple over, again causing the suit coat to wrinkle.

SUMMARY OF THE INVENTION

Accordingly, it is an object of the present invention to provide a carry-along garment bag that eliminates the above-noted disadvantages in the prior art.

Another object of the present invention is to provide a carry-along garment bag that is lighter in weight for transport.

According to the present invention a carry-along garment bag is provided that can be carried alone or attached to a carrying case comprising means for housing a garment piece therein, means for supporting the garment bag means in a folded state to reduce the possibility of the garment bag piece becoming wrinkled therein, and a means for securing the garment bag means for housing to a carrying case.

DETAILED DESCRIPTION OF THE PREFERRED EMBODIMENT

The present invention will now be described in detail with reference to the drawings.

Figure 1:
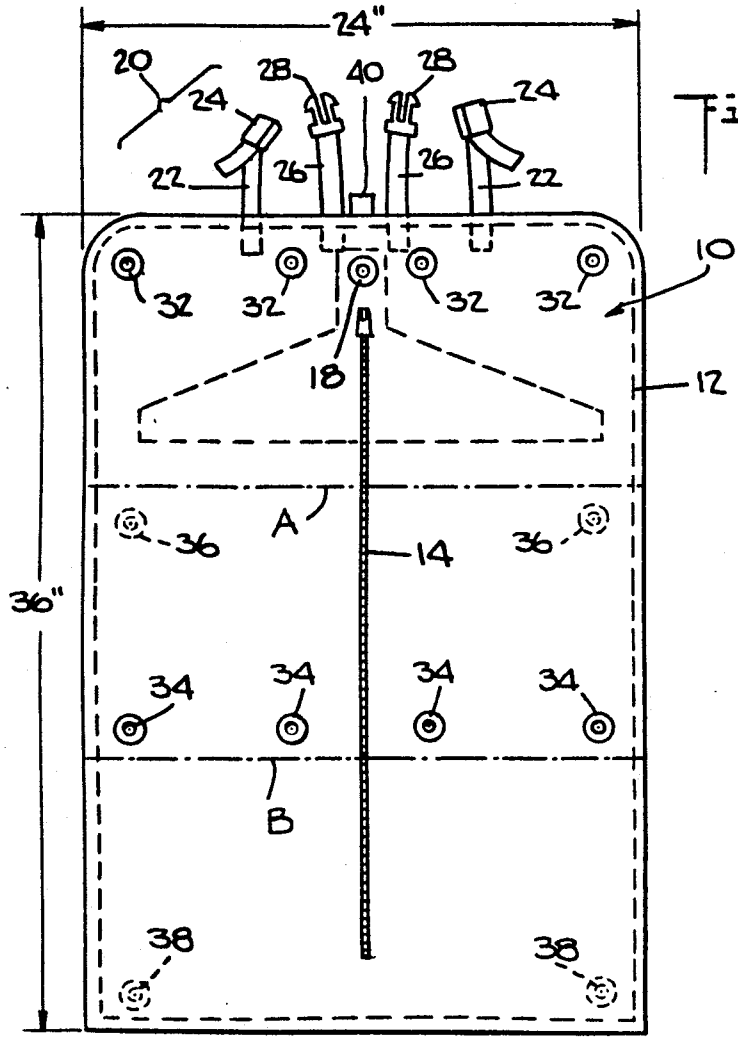
FIG. 1 shows a front view of the carry-along garment bag of the present invention in an unfolded state.

Referring to FIG. 1, there is shown a front view of the carry-along garment bag in an unfolded state. The carry-along garment bag 10 is comprised of two sheets stitched along the outer perimeter of the bag by stitching 12. In the preferred embodiment, the carry-along garment bag 10 is 36" long and 24" wide. In other embodiments, the length and width can vary according to different garment lengths and widths.

The carry-along garment bag 10 contains a zipper 14 located longitudinally in the center of the carry-along garment bag 10. Also located on the surface are female and male snap pairs 32 and 34 (indicated by solid circular lines) for connection to each other. Male and female snap pairs 36 and 38 (indicated by dotted circular lines) are located on the reverse side of the bag, for connection to each other. These snaps pairs are connected to each other so that the carry-along garment bag 10 can be compressed and held in a two-folded state, folded along the lines A and B shown in FIGS. 1 and 4. In other embodiments however, a plurality of snap pairs can be located in numerous positions along the front and reverse surfaces of the bag to effectuate this two folded state.

Figure 2:
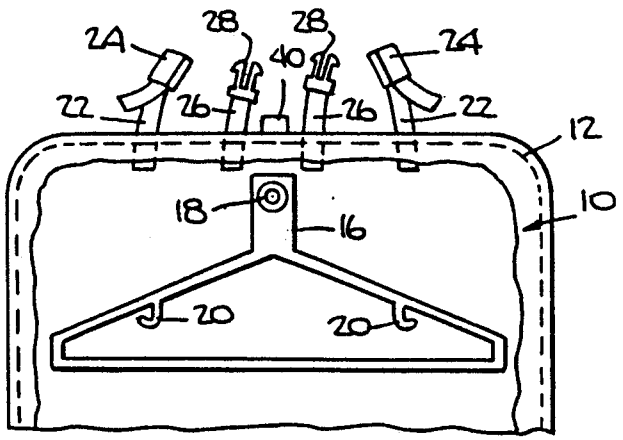
FIG. 2 shows the top portion of the interior of the carry-along garment bag of the present invention.

As shown in FIGS. 1 and 2, located at the very top of the bag are two clip units generally indicated at 30 connected thereto for snug carrying case attachment. Each clip unit 30 comprises an elongated strap 22 stitched in between the two sheets of the carry-along garment bag 10 an adjustable female clip 24 attached to a first elongated strap 22, and a male clip 28 attached to a second elongated strap 26 stitched in between the two sheets of the carry-along garment bag 10.

Figure 3:
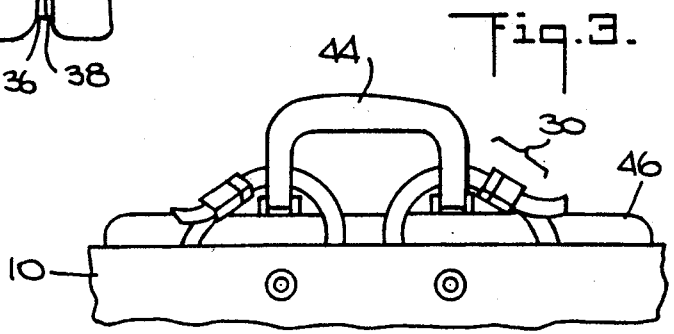
FIG. 3 is a detailed view of the hook-up device of the carry-along garment bag attached to a carrying case.
Figure 4:
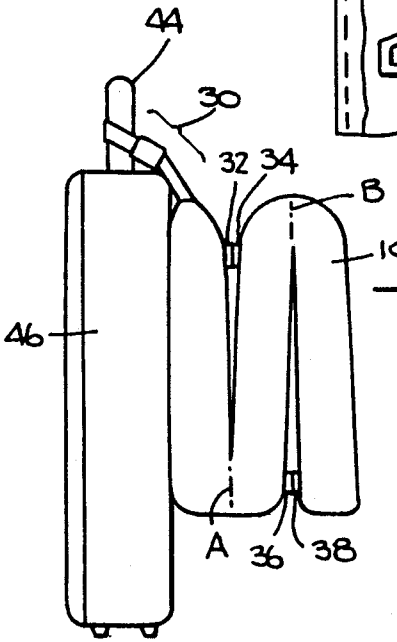
FIG. 4 shows a side perspective of the carry-along garment bag according to the present invention attached to a carrying case in a folded state.

Referring to FIG. 3, there is shown a detail view of the clipped unit 30 attached to a handle 44 of a carrying case 46. Male clips 28 attached to the elongated straps 26 are inserted through the handle 44 and connected to the adjustable female clips 24. By adjusting the elongated straps 22 inserted through the corresponding adjustable female clips 24, the carry-along garment bag 10 can be tightly connected to the handle 44 of the carrying case 46 when the carry-along garment bag 10 is held in a two-folded state as shown in FIG. 4. In other embodiments of the invention, many different types of clips can be used to effectuate the attachment scheme shown in FIG. 3.

Referring to FIG. 2, there is shown an inside view of the hanger 16 of the carry-along garment 10 of the present invention. In the preferred embodiment, the hanger 16 is located in between the two stitched sheets of the carry-along garment 10 and secured with a screw punch or hanger support structure 18 which extends through the bag and hanger and secures the hanger to the bag. However, in other embodiments the hanger 16 can be secured to the carry-along garment bag 10 in other ways. For example, the hanger can be made of a material such that it can be stitched in between the two stitched sheets of the garment bag. The hanger 16 contains hooks 20 for womens' apparel.

Also shown in FIGS. 1 and 2 is a handle 40 for carrying the carry-along garment bag by itself. There are many alternatives, however, to carrying the carry-along garment bag 10. For example, one of the male clips 28 and one of the female clips 24 can be connected together to form an adequate carrying handle.

Referring to FIG. 4, the carry-along garment bag 10 is attached to the handle 44 of a carrying case 46 in a two-folded state along the lines A and B shown in FIG. 1. The male and female snaps 32 and 34 connect together as well as male and female snaps 36 and 38 in order to hold the carry-along garment bag 10 in the two-folded state. Also shown in FIG. 4 is the distance between the bottom of the carry-along garment bag 10 and the bottom of a carrying bag 46 when the carry-along garment bag is held in a two folded state. This clearance is necessary to prevent the bag from scraping against the ground and causing the carrying case 46 to topple over when it is placed in a resting position.

While one preferred embodiment of the present invention has been shown and described, it will be apparent that many modifications and variations could be effected by on skilled in the art without departing from the spirit or scope of the novel concept of the invention, which should be determined by the appended claims.

What is claimed is:

1. A bag adapted to be carried alone or attached to a carrying case, said bag comprising:

means for housing a garment piece therein;

means for supporting said means for housing in a folded state; and means for securing said means for housing to the carrying case;

said means for housing when folded and secured to the carrying case including a first portion connected with the means for securing and extending downwardly therefrom adjacent the carrying case and having an upper portion and a lower portion;

a second portion connected with the lower portion of the first portion and extending upwardly therefrom outwardly of the carrying case and the first portion, said second portion having an upper portion adjacent the upper portion of the first portion, and a third portion connected with the upper portion of the second portion and extending downwardly therefrom and outwardly thereof;

said means for supporting securing said upper portions of said first and second portions in engagment with each other and causing the means for housing to fold in a three-way forward fold.

2. The invention according to claim 1 further comprising a hanger means supported in said housing means for supporting said garment piece.

3. The invention according to claim 2, wherein said housing means has a hanger support structure which extends through said housing means and hanger means and secures said hanger means to said housing means.

4. The invention according to claim 3, wherein said hanger means has an elongated nose through which said hanger support structure extends.

5. The invention according to claim 1, wherein said housing means has a zipper opening through which said garment piece can be inserted.

6. The invention according to claim wherein said means for supporting comprises a plurality of snap pairs on said housing means and evenly spaced therealong and supporting said housing means to a have a vertical height comparable to that of the carrying case.

7. The invention according to claim 1, wherein said means for securing comprises two carrying case hook-ups being attached to said upper portion of the first portion of said housing means and securing said housing means to the handle of said carrying case.

8. The invention according to claim 7, wherein each hook-up includes two elongated straps, one having a female clip and the other having a male complimentary clip for fastening said hook-ups around a handle of said carrying case.

9. The invention according to claim 1, wherein said housing means is a garment bag and further comprises a means for carrying said garment bag by itself.

10. A bag adapted to be carried alone or attached to a carrying case, said bag comprising:

a garment bag means having two sides for housing a garment piece therebetween, said garment bag means has a zipper opening through which said garment piece can be inserted;

means for supporting said garment bag means in a folded state;

means for securing said garment bag means to the carrying case;

said garment bag means, when folded and secured to the carrying case including a first portion connected with the means for securing and extending downwardly therefrom adjacent the carrying case and having an upper portion and a lower portion;

a second portion connected with the lower portion of the first portion and extending upwardly therefrom outwardly of the carrying case and the first portion, said second portion having an upper portion adjacent the upper portion of the first portion, and a third portion connected with the upper portion of the second portion and extending downwardly therefrom and outwardly thereof;

said means for supporting securing said upper portions of said first and second portions in engagment with each other and causing the garment bag means to fold in a three-way forward fold; and hanger means supported in said garment bag means for supporting said garment piece, said garment bag means has a hanger support structure which extends through said garment bag means and hanger means and secures said hanger means to said garment bag means, said hanger means has an elongated nose through which said hanger support structure extends.

11. The invention according to claim 10, wherein said means for supporting comprises a plurality of snap pairs on said garment bag means and evenly spaced therealong and supporting said garment bag means to a have a vertical height comparable to that of the carrying case.

12. The invention according to claim 10, wherein said means for securing comprises two carrying case hook-ups being attached to said upper portion of the first portion of said garment bag means and securing said garment bag means to the handle of said carrying case.

13. The invention according to claim 12, wherein each hook-up includes two elongated straps, one having a female clip and the other having a complimentary male clip for fastening said hook-ups around the handle of said carrying case.

14. The invention according to claim 10, wherein said garment bag means further comprises a means for carrying said garment bag means by itself.

15. A bag adapted to be carried alone or attached to a carrying case, said bag comprising:

a garment bag means having two sides for housing a garment piece therebetween, said garment bag means has a zipper opening through which said garment piece can be inserted;

means for maintaining said garment bag means in a folded state such that said garment piece will remain unwrinkled therein, means for fastening said garment bag means to a carrying case comprising two carrying case hook-ups having two elongated straps, one ending in a female clip and the other ending in a complimentary male clip for fastening said hook-ups around the handle of said carrying case, said maintaining means comprises a plurality of snap pairs evenly space along said garment bag for maintaining said garment bag means in a two-folded state;

said garment bag means, when folded and fastened to the carrying case, including a first portion connected with the means for fastening and extending downwardly therefrom adjacent the carrying case and having an upper portion and a lower portion;

a second portion connected with the lower portion of the first portion and extending upwardly therefrom outwardly of the carrying case and the first portion, said second portion having an upper portion adjacent the upper portion of the first portion, and a third portion connected with the upper portion of the second portion and extending downwardly therefrom and outwardly thereof;

said means for maintaining securing said upper portions of said first and second portions in engagment with each other and causing the garment bag means to fold in a three-way forward fold; and a hanger means attached inside said garment bag means for hanging said garment piece; and a means for carrying said garment bag means by itself, said garment bag means has a hanger support means which is secured to said garment bag means and hanger means in order to secure said hanger means to said garment bag means, said hanger means has a elongated nose through which said hanger support means is secured in order to provide space between said garment piece and said hanger support means when said garment piece is contained in said garment bag means.

* * * * *